US005584781A

United States Patent [19]

Chen

[11] Patent Number: 5,584,781

[45] Date of Patent: Dec. 17, 1996

[54] STRIDING EXERCISER

[76] Inventor: Paul Chen, 5th Floor, No. 31, Gan Tzou 2nd Street, Shi Tun Chu, Taichung, Taiwan

[21] Appl. No.: 638,736

[22] Filed: Apr. 29, 1996

[51] Int. Cl.[6] ..... A63B 22/00

[52] U.S. Cl. ..... 482/51; 482/52

[58] Field of Search ..... 482/51, 52, 53, 482/70, 54, 79, 74, 130, 129, 148; 434/255

[56] References Cited

U.S. PATENT DOCUMENTS

| | | | |
|---|---|---|---|
| 4,563,001 | 1/1986 | Terauds | 482/53 |
| 4,850,585 | 7/1989 | Dalebout et al. | 482/70 |
| 4,861,023 | 8/1989 | Wedman | 482/51 |
| 4,940,233 | 7/1990 | Bull et al. | 482/52 |
| 4,989,858 | 2/1991 | Young et al. | 482/53 |
| 5,000,443 | 3/1991 | Dalebout et al. | 482/52 |
| 5,290,211 | 3/1994 | Stearns | 482/53 |
| 5,419,747 | 5/1995 | Piaget et al. | 482/51 |
| 5,496,235 | 3/1996 | Stevens | 482/51 |

*Primary Examiner*—Stephen R. Crow
*Attorney, Agent, or Firm*—Charles E. Baxley, Esq.

[57] ABSTRACT

A striding exerciser includes a pair of post having a middle portion pivotally coupled to an upper portion of a base. The base has a rod rotatably supported in an upper and front portion. The rod has a lever secured to one end and extended upward and has another lever secured to the other end and extended downward. A pair of links pivotally couple the posts to the levers respectively so as to couple the posts together. One of the links is moved forward when the other link moves rearward, and is moved rearward when the other link moves forward.

2 Claims, 2 Drawing Sheets

STRIDING EXERCISER

BACKGROUND OF THE INVENTION

1. Field of the Invention

The present invention relates to an exerciser, and more particularly to a striding exerciser.

2. Description of the Prior Art

Several typical striding exercisers have been developed. U.S. Pat. No. 4,645,200 to Hix, U.S. Pat. No. 4,850,585 to Dalebout, and U.S. Pat. No. 5,000,443 to Dalebout et al. are three examples of the exercisers. However, some of the typical striding exercisers comprise a complicated configuration that may not be easily manufactured and assembled.

The present invention has arisen to mitigate and/or obviate the afore-described disadvantages of the conventional striding exercisers.

SUMMARY OF THE INVENTION

The primary objective of the present invention is to provide a striding exerciser having a simplified configuration that is excellent for manufacturing and assembling purposes.

In accordance with one aspect of the invention, there is provided a striding exerciser comprising a base including an upper portion having a pair of pivot shafts provided therein and including an upper and front portion having a rod rotatably supported therein, the rod including a first end having a first lever secured thereto and extended upward therefrom and including a second end having a second lever secured thereto and extended downward therefrom, a pair of posts each including a middle portion pivotally coupled to the base at the pivot shaft so as to allow the posts to be rotated about the pivot shafts respectively, the posts each including an upper portion having a handle provided thereon and each including a lower portion having a foot support provided thereon, and a first link and a second link pivotally coupling the posts to the first and the second levers respectively so as to couple the posts together. The first link is moved forward when the second link moves rearward, and the first link is moved rearward when the second link moves forward.

A support includes a first end pivotally coupled to the base at an axle and rotated to a horizontal position for forming a stable base when the support is secured to the base.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 2:
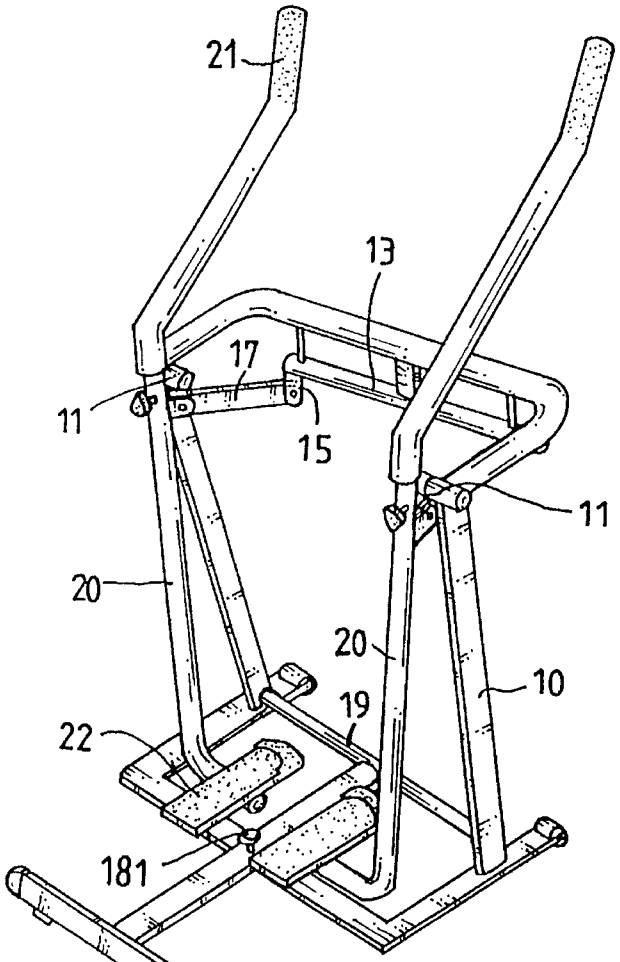
FIGS. 1 and 2 are front and rear perspective views of a striding exerciser in accordance with the present invention.
Figure 1:
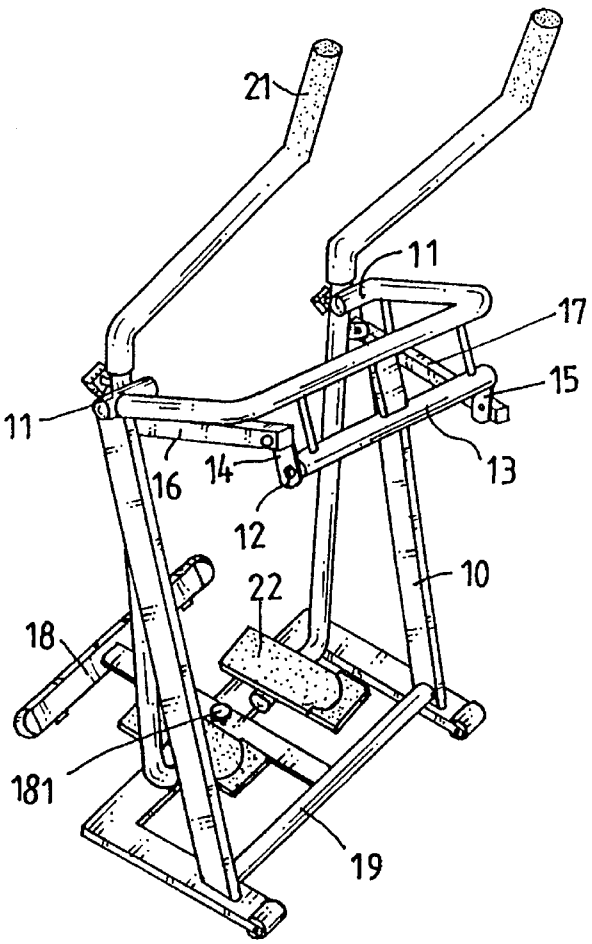
Figure 3:
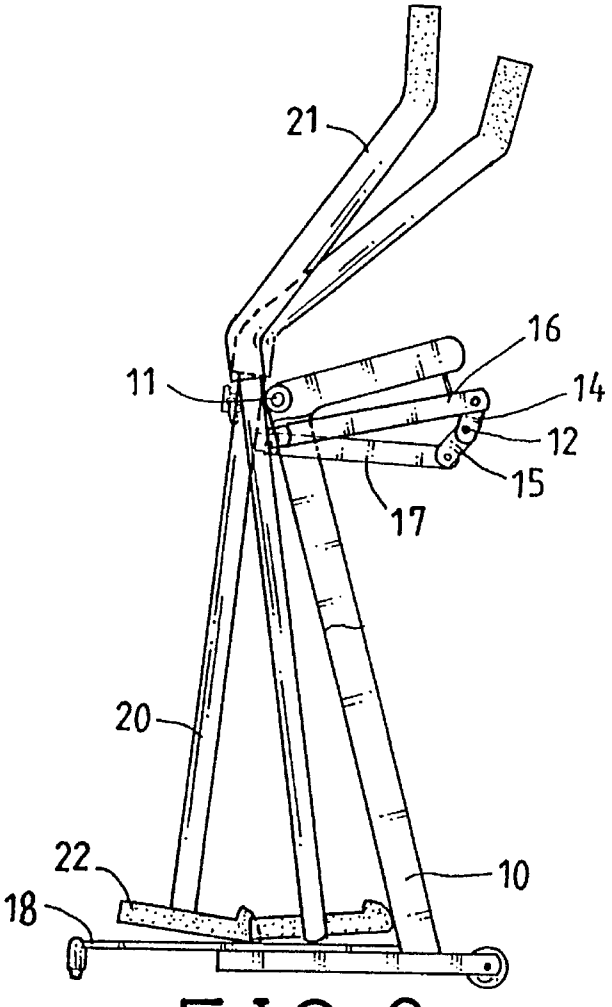

Referring to the drawings, and initially to FIGS. 1 to 3, a striding exerciser in accordance with the present invention comprises a base 10 including an upper portion having a pair of pivot shafts 11 provided therein and including an upper and front portion having a rod 12 rotatably supported in a tube 13. The rod 12 includes one end having a lever 14 secured thereto and extended upward therefrom and includes the other end having another lever 15 secured thereto and extended downward therefrom. A pair of posts 20 include a middle portion pivotally coupled to the base 10 at the pivot shafts 11 such that the posts 20 are rotatable about the pivot shafts 11. The posts 20 each includes a handle 21 provided on top thereof and each includes a foot support 22 provided on the bottom thereof. A pair of links 16, 17 pivotally couple the posts 20 to the levers 14, 15 respectively such that the posts 20 are coupled together by the links 16, 17 and the levers 14, 15 and the rod 12. A T-shaped support 18 has one end pivotally coupled to the base 10 by an axle 19 and rotatable to a horizontal position for forming a stable base when the support 18 is secured to the base 10 by a fastening member 181. The support 18 is rotatable about the axle 19 to a vertical and folded position.

Figure 4:
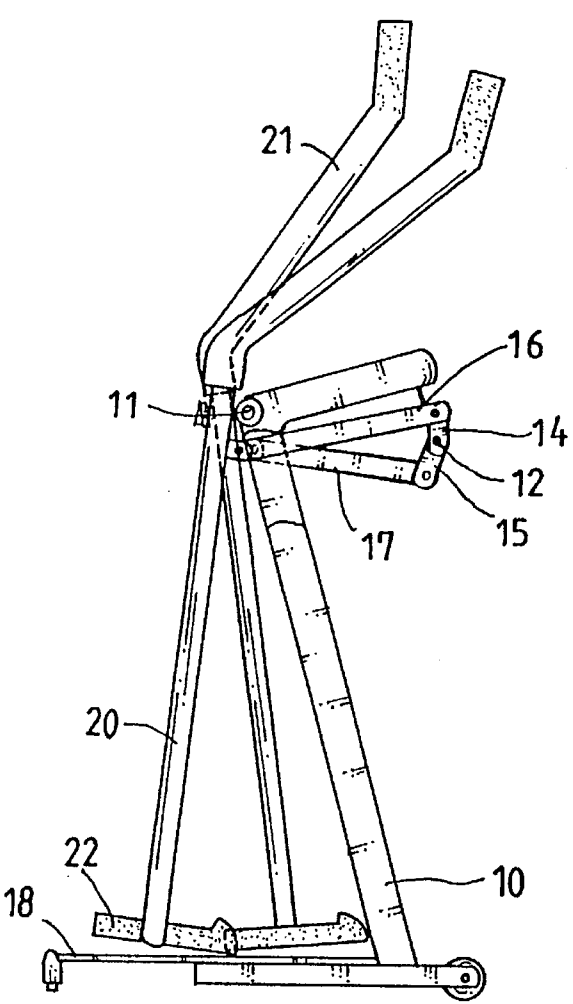
FIGS. 3 and 4 are side views illustrating the operation of the striding exerciser.

In operation, as shown in FIG. 3, the lever 14 is rotated clockwise by the link 16 when the posts 20 secured to the link 16 is moved forward. At this moment, the lever 15 and the rod 12 are rotated clockwise by the lever 14 such that the other post 20 which is secured to the link 17 may be caused to move rearward. As shown in FIG. 4, the forward movement of the link 17 may cause the link 16 to move rearward. The user may thus simulate walking exercise.

Accordingly, the striding exerciser in accordance with the present invention includes a simplified configuration that is excellent for manufacturing and assembling purposes. The posts are coupled together by the links and the levers so as to be moved in concert with each other.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A striding exerciser comprising:

a base including an upper portion having a pair of pivot shafts provided therein and including an upper and front portion having a rod rotatably supported therein, said rod including a first end having a first lever secured thereto and extended upward therefrom and including a second end having a second lever secured thereto and extended downward therefrom, a pair of posts each including a middle portion pivotally coupled to said base at said pivot shaft so as to allow said posts to be rotated about said pivot shafts respectively, said posts each including an upper portion having a handle provided thereon and each including a lower portion having a foot support provided thereon, and a first link and a second link pivotally coupling said posts to said first and said second levers respectively so as to couple said posts together, said first link being moved forward when said second link moves rearward, and said first link being moved rearward when said second link moves forward.

2. A striding exerciser according to claim 1 further comprising a support including a first end pivotally coupled to said base at an axle and rotated to a horizontal position for forming a stable base when said support is secured to said base.

* * * * *